US009783339B1

(12) United States Patent
Atkinson et al.

(10) Patent No.: US 9,783,339 B1
(45) **Date of Patent: *Oct. 10, 2017**

(54) REUSABLE DISPENSING APPARATUS

(75) Inventors: Lucas James Atkinson, Minneapolis Woodbury, MN (US); Christopher Alton Horne, Pensacola, FL (US)

(73) Assignee: LJA Companies, LLC, Woodbury, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/560,879

(22) Filed: Jul. 27, 2012

Related U.S. Application Data

(60) Provisional application No. 61/524,582, filed on Aug. 17, 2011, provisional application No. 61/511,415, filed on Jul. 28, 2011.

(51) Int. Cl.
*B67D 1/07* (2006.01)
*B65D 21/02* (2006.01)

(52) U.S. Cl.
CPC ..... *B65D 21/0209* (2013.01)

(58) Field of Classification Search
CPC ..... B05B 15/005; B05B 15/006; B65D 81/32; B65D 21/0209
USPC ..... 222/192, 416, 464.1–464.7, 129; 215/374–378
See application file for complete search history.

(56) References Cited

U.S. PATENT DOCUMENTS 1,903,312 A 4/1933 Ellis
1,942,953 A 1/1934 Bennett
3,727,797 A 4/1973 Cronan
3,768,706 A * 10/1973 Hill ..... 222/325
4,470,526 A 9/1984 Cha et al.
4,488,584 A 12/1984 Hestehave et al.
RE32,458 E 7/1987 DeLay, Jr.
4,705,191 A * 11/1987 Itzel ..... B05B 11/0037 141/326
4,802,599 A 2/1989 Hill
5,022,567 A 6/1991 Frazer
5,062,549 A 11/1991 Smith et al.
5,101,870 A 4/1992 Farris
5,366,119 A 11/1994 Kline
5,439,141 A 8/1995 Clark et al.
5,464,129 A 11/1995 Ho
D411,748 S 6/1999 Klima, Jr. et al.
(Continued)

FOREIGN PATENT DOCUMENTS

DE 19645620 A1 * 5/1998

*Primary Examiner* — Lien Ngo
(74) *Attorney, Agent, or Firm* — Berggren Law Offices, LLC; William R. Berggren; Stephen F. Wolf

(57) ABSTRACT

A reusable fluid dispensing system comprising a fluid dispensing head with a descending dip tube having an end and a container for holding fluid that is detachably connected to the fluid dispensing head. The container has a bottom that has a single lower recess region to receive the dip tube end, a detachable base member defining at least one region and, within that region, at least one accessory. The accessory is from a group consisting of a funnel for use in dispensing fluid concentrate and dilution fluid in to the container, a reusable non-paper sheet-like or pad-like element for smoothly spreading dispensed fluid onto a surface or scouring or polishing the surface, and concentrate for making the fluid when dissolved in dilution fluid. In addition, methods of use are taught.

11 Claims, 8 Drawing Sheets

(56) References Cited

U.S. PATENT DOCUMENTS

| | | | | |
|---|---|---|---|---|
| 6,209,595 | B1 | 4/2001 | Granath | |
| 6,223,792 | B1 | 5/2001 | Slagle | |
| 6,321,937 | B1 | 11/2001 | DeSimone et al. | |
| 6,431,405 | B2 | 8/2002 | Irwin | |
| 6,752,297 | B1 * | 6/2004 | Ische | 222/464.7 |
| 7,690,521 | B1 | 4/2010 | Herrera | |
| D642,060 | S | 7/2011 | Leclair et al. | |
| 8,322,352 | B2 * | 12/2012 | Lampugnale | A45D 29/007 132/73 |
| 2001/0030203 | A1 | 10/2001 | Weber | |
| 2006/0102585 | A1 | 5/2006 | Richardson | |
| 2006/0186144 | A1 | 8/2006 | Tinsley | |
| 2006/0201900 | A1 * | 9/2006 | de Francesco | 215/6 |
| 2007/0108156 | A1 * | 5/2007 | Durand et al. | 215/375 |
| 2007/0233012 | A1 | 10/2007 | Lerrick et al. | |
| 2009/0008414 | A1 * | 1/2009 | Tingsley | 222/377 |
| 2009/0107582 | A1 | 4/2009 | Sayage | |
| 2009/0294468 | A1 * | 12/2009 | Tom | 222/1 |
| 2011/0180568 | A1 | 7/2011 | Gillispie et al. | |

* cited by examiner

REUSABLE DISPENSING APPARATUS

CROSS REFERENCE TO RELATED APPLICATIONS

This application claims the benefit of PPA App. No. 61/511,415 filed Jul. 28, 2011 and PPA App. No. 61/524,582 filed Aug. 17, 2011 by Lucas James Atkinson.

FIELD OF THE INVENTION

This invention relates to a spray head and a pump reusable dispensing apparatus that dispense nearly all of the fluid in the apparatus and has a false bottom that further contain essential but easily misplaced items such as funnels, cleaning wipes and packets of concentrate.

BACKGROUND OF THE INVENTION

There is a need, particularly in the cleaning and pesticide industry, for dispensing containers that reduce the waste of unused fluid product and has essential auxiliary products readily available.

In the current "green" climate, there is a growing desire to reduce waste and increase reuse with convenience. This is especially true for dispensers those with expensive and hazardous fluid products such as cleaners, pesticides, and weed-killers. Present containers often leave a significant amount of fluid product that is not dispensable because of such causes as a dip tube that does not reach the bottom or fluid that cannot reach the dip tube opening. Disposing of these containers with unusable fluid product is a growing problem in such places as landfills. The above problem is exacerbated for professionals such as, for example, cleaners, gardeners and pest control specialists who go through significantly more containers.

Reusable dispensing containers have been taught with limited use by society even though reusable dispensing container would have a large beneficial effect on landfills. Oftentimes beneficial auxiliary articles that are necessary for the convenient reuse of containers are misplaced or not available in a prompt manner. This lack of convenience has resulted in a preference by consumers to use single use containers rather than reuse containers.

There still is a need, particularly in the cleaning, gardening and pesticide industries, for a dispensing container of general use that reduces the waste of not dispensed fluid product and has beneficial auxiliary products readily accessible when needed to encourage reuse of the container.

SUMMARY OF THE INVENTION

We have invented a dispensing container for general use that reduces the waste of not dispensable fluid product and contains beneficial auxiliary products that are readily accessible when needed to encourage use and reuse of the container. The fluid-dispensing apparatus comprises four elements. The first element is a fluid dispensing head with a descending dip tube having an end. The second element is a container for holding fluid that is detachably connected to the fluid dispensing head and has four features. The first feature is a top with an opening detachably connected to the dispensing head, an outer edge, and a periphery. The second feature are sides having a top edge, a horizontal periphery, a bottom edge where the top edge is continuously affixed to the entire outer edge of the top, and a bottom having an outer edge affixed to the bottom edge of the side. The third feature is a bottom having an outer perimeter that is continuously affixed to the bottom edge of the sides and a single lower region configured to accept the end of the dip tube such that the end of the dip tube is in the lower region. In addition, the bottom has a shape that is tapered to direct fluid toward the lower region in the bottom. The fourth feature is an outside region from just above the beginning of the taper to the lower region, the outside region having affixing elements. The third element is a base member having an inside surface and attaching elements on the inside surface, and detachably connected to the container at the affixing elements to provide an approximately horizontal supporting orientation for the apparatus, the base member defining at least one region within the member that can contain at least one accessory. The fourth element is the accessory within the base that is from a group consisting of a funnel for use in dispensing fluid concentrate and dilution fluid into the container, a one reusable non-paper sheet or pad element for smoothly spreading dispensed fluid onto a surface or scouring or polishing the surface, and concentrate for making the fluid when dissolved in dilution fluid.

We have also invented a separate method of using each of the accessories mentioned in the apparatus above. The first method comprises eight steps. First is providing the above apparatus with the accessory comprising a funnel for use in dispensing fluid concentrate and dilution fluid in to the container. Second is providing concentrate fluid product. Third is detaching base member from container and removing funnel. Fourth is removing dispensing head and placing funnel over top opening. Fifth is adding concentrate fluid product in measured amount without spilling. Sixth is adding diluting fluid without spilling. Seventh is removing funnel and replace dispensing head on top. Eighth is reattaching base member to container with funnel within the base member.

The second method comprises five steps. First is providing the above apparatus with the accessory comprising a reusable non-paper sheet or pad wipe for smoothly spreading dispensed fluid onto a desired surface or scouring or polishing the surface. Second is providing fluid product to apparatus. Third is applying product to desired surface in droplet form. Fourth is removing wipe from base member. Fifth is spreading product onto desired surface in a continuous coating. Sixth is returning the wipe to the base member.

The third method comprises six steps. First is providing the above apparatus with the accessory comprising concentrate for making the fluid when dissolved in water. Second is removing concentrate from base member. Third is removing dispensing head. Fourth is adding concentrate fluid product in measured amount. Fifth is adding diluting fluid. Sixth is replacing dispensing head on top.

As used herein:

"Concentrate" means a fluid-soluble concentrate in a pre-weighed amount that is dissolved that will thoroughly dissolve in a reasonable period of time of less than 30 minutes with water, alcohol, other fluids, or mixtures thereof.

"Wipe" means a reusable non-paper sheet or pad wiping element for smoothly spreading dispensed fluid onto a surface or scouring a surface once fluid is dispensed. The element made of a material that is not disposable paper such as retail paper towels or tissue paper, but is composed of material such as, for example, cloth, micro-porous non-woven polymeric material or membranes that is washable in a washing basin or conventional residential washing machine, reusable sponges and scouring pads such as, for example, SCOTCH BRITE® by 3M Company of Maplewood, Minn., and pliable materials such as a clay used to polish surfaces such as painted automotive surfaces.

Our invention has several benefits over what is known. Our invention permits more fluid to be dispensed than conventional containers with flat bottoms. In addition, our invention allows the user the convenience of readily having useful articles available such as at least a funnel, wipe or concentrate. Our invention uses these features in combination to increase the convenience and utility of our apparatus as a reusable fluid dispensing apparatus. Users are encouraged by the convenience of the readily accessible accessories to use our invention with its efficient fluid dispensing construction in a reusable manner in conjunction with fluid concentrates instead of purchasing single use containers that are disposed of into landfills after use, often with undispensed fluid.

BRIEF DESCRIPTION OF THE DRAWINGS

One or more features or preferred forms of the invention are described in the accompanying drawings. The drawings are described briefly below.

DETAILED DESCRIPTION OF SOME EMBODIMENTS OF THE INVENTION

Figure 1:
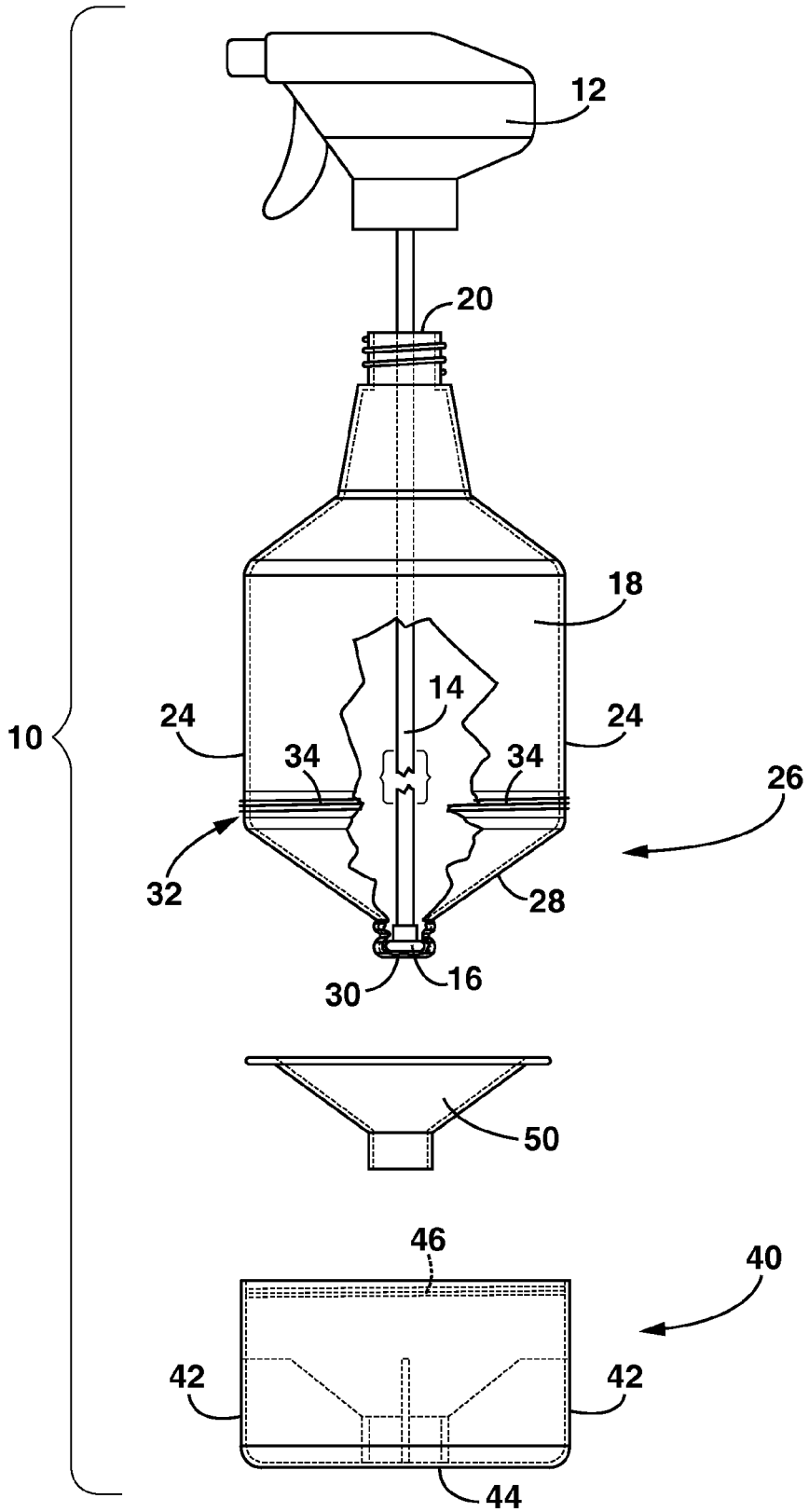
FIG. 1 is a cut-away exploded perspective view of one embodiment of the invention with spray head and a funnel.

There is a growing desire in society to use resources more responsibly. This is particularly true for fluid dispensing containers. However, users are reluctant to use reusable products if there is any inconvenience over using single use. There is a need for a reusable fluid containing apparatus that more closely meet with current "green" trends and include additional objects useful in handling the fluid with the bottle for convenience of the user. The accessories act as an incentive to encourage users to purchase concentrates and use our reusable dispensers to both consume almost all of the fluid in a useful manner and to minimize the number of containers that are thrown away and typically end up in landfills.

Known fluid dispensing containers that may have some relevance to our invention can be categorized into nine groups. Group One comprises spray bottles with sloping bottoms, a horizontal base, and no accessory. Representative references include the following. U.S. Pat. No. 4,470,526 teaches a pump head fluid dispensing bottle with dip-tube, conical shaped inner bottom surface and a complex arrangement at the lowest point that holds the end of the dip tube at that point, no detachable base, and no accessory. U.S. Pat. No. 5,062,549 teaches a hand-held dip-tube style liquid dispenser with a v-shaped bottom, a base that suggests no reason for being repeatedly detachable, and no accessory. U.S. D642,060 teaches a bottle with a conical internal bottom, a base that suggests no reason for being repeatedly detachable, and no accessory. U.S. 2001/0030203 teaches a dip-tube style soap-dispensing container with a conical bottom, a base that suggests no reason for being repeatedly detachable, and no accessory. U.S. Pat. No. 5,366,119 teaches a dip-tube style dispenser bottle with internal pump, conical bottom, a base not designed to be detachable, and no accessory. U.S. Pat. No. 5,464,129 teaches a dip-tube style pump-dispensing bottle with a slanting internal bottom and no base that is designed to b e removed. U.S. 2006/0186144 teaches a dip-tube style spray bottle with a conical bottom, detachable screw-on base, and no accessory. U.S. 2011/0180568 teaches a dip-tube style spray bottle with a centrally recessed bottom, a base that suggests no reason for being repeatedly detachable, and no accessory.

Group Two comprises dip-tube style dispensing containers with internally disposed "funnels" that are merely conical bottom arrangements and no accessories. Representative references include the following. U.S. 2007/0233012 teaches a multi-chamber spray container and system with each container having a conical or "funnel" bottom, non-detachable base, and no accessory. U.S. Pat. No. 3,727,797 teaches a dual compartment spray container for combining two fluids at the base of an open internal "funnel" or conical bottom with one above the surface of the cone and the other below, a non-detachable base with a centrally positioned plugged opening to permit entry of the second fluid, and no accessory.

Group Three comprises fluid containers with separable funnels attached to a container wall but no conical bottoms, fluid dispensing heads, or dip-tubes. Representative references include the following. U.S. Pat. No. 4,488,584 teaches a drainer container for collecting used engine oil with a detachable funnel and no detachable base. U.S. Pat. No. 4,802,599 teaches an engine oil collector system with a detachable funnel, and no detachable base. U.S. Re 32,458 teaches a portable engine oil-collecting container with interlocking funnel attached to top of container, and no detachable base.

Group Four comprises fluid containers with a detachable funnel disposed above the top closure, and no spray or pump action fluid dispensing head, no conical bottom, no detachable base, or no dip-tube. Representative references include the following. U.S. 2009/0107582 teaches a fluid dispensing container with a detachable funnel disposed above the top closure. U.S. Pat. No. 6,209,595 teaches a dispenser with a detachable funnel disposed above the top closure. U.S. Pat. No. 5,022,567 teaches a fluid containing bottle with detachable funnel disposed above the top closure.

Group Five comprises fluid containers with a detachable funnel disposed below the top closure, and no spray or pump action fluid dispensing head, no conical bottom, no detachable base, or no dip-tube. Representative references include the following. U.S. Pat. No. 7,690,521 teaches a beverage bottle nipple-adapter and bottle with detachable funnel disposed below the top closure. U.S. Pat. No. 5,101,870 teaches a conforming funnel and disposable fluid container bottle with detachable funnel disposed below the top closure. U.S. Pat. No. 6,223,792 teaches a fluid container with detachable funnel disposed below the top closure.

Group Six comprises refillable spray bottles with second opening/closure for the refilling process, no conical bottom, no detachable base, and no accessory. Representative references include the following. U.S. Pat. No. 5,439,141 teaches a liquid spray head that can draw simultaneously from two different liquid reservoirs and a bottle with two openings. U.S. D411,748 teaches a refillable spray bottle with second opening. U.S. Pat. No. 4,705,191 teaches a mixing and spraying device with concentrate in a pre-weighed single use sealed cap.

Group Seven comprises dispensing bottles containing detachable bases to hold other personal items but no dip-tube, no spray or pump style dispensing head, no conical bottom, and no accessory. A representative reference includes the following. U.S. 2006/0102585 teaches a reusable water bottle that containing a detachable base member that can be used to hold change, car keys or other personal objects of the user's choice.

Group Eight comprise fluid dispensing bottles with disposable paper wipes as accessories and small containers for holding fluid but no conical bottom. Representative references include the following. U.S. Pat. No. 6,431,405 teaches a dispensing container with pump style dispensing head, a dip tube, a reverse conical bottom having a lower circular rim region, and a detachable base with a refillable group of paper towels and paper towel dispenser. U.S. Pat. No. 6,321,937 teaches a pressurized aerosol dispenser with a dip tube, a reverse conical bottom having a lower circular rim region, and a detachable base with a refillable group of paper towels and paper towel dispenser. U.S. Pat. No. 1,903,312 teaches a container for holding medicating fluid with a flat bottom and a detachable base containing disposable applying wipes, no dip-tube, and no spray or pump style dispensing head.

Group Nine comprise fluid containers with reusable cloth wipes as accessories but no dip-tube, no spray or pump style dispensing head, and no conical bottom. A representative reference includes the following. U.S. Pat. No. 1,9542,953 teaches a fluid container for holding liquid polish or cleaner, attached to a second container for a holding an application and polishing cloth, and a detachable cap for accessing and returning the application and polishing cloth.

All of the above classes lack the meaningful combination of our invention. They either lack (1) the dispensing container with a dip tube touching the recess of a bottom that slopes to a single point to minimize the amount of fluid that cannot be dispensed or (2) insertion in a base element of at least one desirable accessory used in conjunction with the dispensing of a fluid. Our invention embodies this combination that would enhance the use and reuse of fluid conservation dispensing containers. Thus, our invention would benefit the environment by minimizing the disposal, often in landfills, of dispensing containers with unused and often toxic fluid and the great number of single use containers that are currently predominately used by consumers.

Specifically our invention comprises four elements. The first element is a fluid dispensing head with a descending dip tube having an end. The second element is a container for holding fluid that is detachably connected to the fluid dispensing head. The third element is a base member having an inside surface and attaching elements on the inside surface, and detachably connected to the container at the affixing elements to provide an approximately horizontal supporting orientation for the apparatus, the base member defining at least one region within the member that can contain at least one accessory. The fourth element is the accessory within the base that is from a group consisting of a funnel for use in dispensing fluid concentrate and dilution fluid in to the container, a reusable non-paper sheet-like element for smoothly spreading dispensed fluid onto a surface, and solid concentrate for making the fluid when dissolved in dilution fluid.

The first element is a fluid dispensing head with a descending dip tube having an end. The head is attached in a releasable manner to the top of a container, typically by such methods known to the art as, for example, screw-fastening threads or snap fittings. Dispensing heads are those that dispense fluid with repetitive hand squeezing motions without the need to first pressurize the container. Representative heads include, for example, spray style heads and pump style heads. These heads are connected to dip tubes that descend into the container with ends that are proximate to the lowest point of the container.

The second element is the container for holding fluid that is connected in a detachable manner to the fluid dispensing head. The container has four features. The first feature is a top with an opening detachably connected to the dispensing head, an outer edge, and an outer edge periphery. The second feature is sides having a top edge, a horizontal periphery, a bottom edge where the top edge is continuously affixed to the entire outer edge of the top edge of the sides, and a bottom having an outer edge affixed to the bottom edge of the side. The third feature is a bottom having a shape that is tapered to direct fluid toward a single lower region in the bottom, the lower region being configured to accept the end of the dip tube. In some embodiments, the taper is in the form of a cone with the apex that points downward being a recessed single lower region. In some embodiments, the taper is in the form of a tilted slant. In some embodiments the bottom is detachably attached the sides so that the container may be more easily cleaned between uses. The fourth feature is an outside region from just above the beginning of the taper to the lower region, the outside region having affixing elements.

The sides of the container may have a variety of shapes. The horizontal periphery for some embodiments may be from a group consisting of a circle, oval, square, rectangle and polygon or a series of shapes stacked one on the other. The horizontal periphery for other embodiments may be of some other regular or irregular shape. The shape of the horizontal periphery may vary as one goes from the bottom the top.

The third element is a base member with an inside surface and attaching elements on the inside surface. The base is detachably connected to the container at the affixing elements to provide an approximately horizontal supporting orientation for the apparatus. The base member defines at least one region within the member that can contain at least one accessory.

The affixing elements of the outside region have varied forms and are designed to mate with attaching elements of the base. Affixing and attaching elements are known to the art and include, for example, ridges and groves for snap-on releasable attachment, male and female threads for screw-like releasable attachment, mechanical fasteners for releasable entanglement attachment, and friction surfaces for dry releasable adhesion attachment.

The base may be detachably attached to the container in several different ways. Some embodiments may have the base attached to the outside region proximate the outside edge of the bottom of the sides. Some embodiments may have the base attached to the outside region proximate the outside of the lower region of a recessed single lower region where the bottom tapers downward in the shape of a cone with the apex being a recessed single lower region. In some embodiments, the base has at least three legs. In some embodiments, the base has a continuous side affixed to a substantially horizontal bottom.

The fourth element is the accessory within the base that is from a group consisting of a funnel for use in dispensing fluid concentrate and dilution fluid in to the container, a reusable non-paper sheet or pad element for smoothly spreading dispensed fluid onto a surface, or scouring or polishing the surface, and solid concentrate for making the fluid when dissolved in dilution fluid. Some embodiments have a lip that extends outward in a substantially horizontal manner from the bottom of the base to increase the standing stability of the apparatus.

As stated above, the accessory is an item that is used frequently in the use of the container as a reusable fluid container. Often, a user misplaces these accessories or stores them in locations that are different from that where the fluid dispensing container is stored or the fluid used in the container is stored and subsequently is forgotten about. Past such experiences result in consumers reluctant to buy reusable fluid dispensers even where they would clearly be useful in minimizing waste. Some fluids useful for use in our dispenser containers are fluids that are available in concentrated form that are diluted before use. Some fluids are available in larger containers used to supply fluid dispensing containers. Some are first available in solid concentrate forms that have to be dissolved before use in a fluid dispensing container. Types of fluids that would benefit from our invention include such fluids as, for example, lawn and garden pesticides, outdoor insecticides, and cleaning and disinfectant materials.

The three more useful accessories with the methods of using the apparatus containing them are described separately below. In addition, FIGS. 1 through 8 depict several aspects of our invention using at least these accessories. All similar elements are designated with the same number.

Funnel Accessory

Some embodiments are a fluid dispensing apparatus comprising at least a funnel for use in dispensing fluid concentrate and dilution fluid in to the container. In some embodiments, the funnel is affixed to the outside of the lower recess of the container. In some embodiments of the previous embodiments, the funnel and the base are the same and the funnel is used to allow the apparatus to stand substantially in a horizontal position. In some embodiments, the funnel fits proximate but unattached to the contour of the tapered bottom. In some embodiments, the funnel fits proximate to the contour of the tapered bottom and is detachably attached to the underside of the bottom or to the inner sides of base.

FIGS. 1 through 4 depict several embodiments where the accessory is a funnel. FIG. 1 is a cut-away exploded perspective view of one embodiment of the invention with spray head and a funnel. The fluid dispensing apparatus (10) is composed of four elements. First is a fluid dispensing head of a spray type (12) with a dip tube (14) having an end (16). Second is a fluid dispensing container (18) comprising a top (20), a side (24) comprising two widening truncated cones and a cylinder, and a bottom (26) with a tapered shape (28) ending in a single lower region (30), in this embodiment a recessed region with dip tube end 16 proximate lower region 30. An outer region (32) has an affixing element (34), a threaded surface. Third is a base (40) having a side (42), a base (44) that is substantially horizontal, and an attaching element (46) inside the upper inside of the side, a threaded surface. Fourth is a funnel accessory (50) that is placed proximate the outside of bottom 26 and within base 40.

Figure 2:
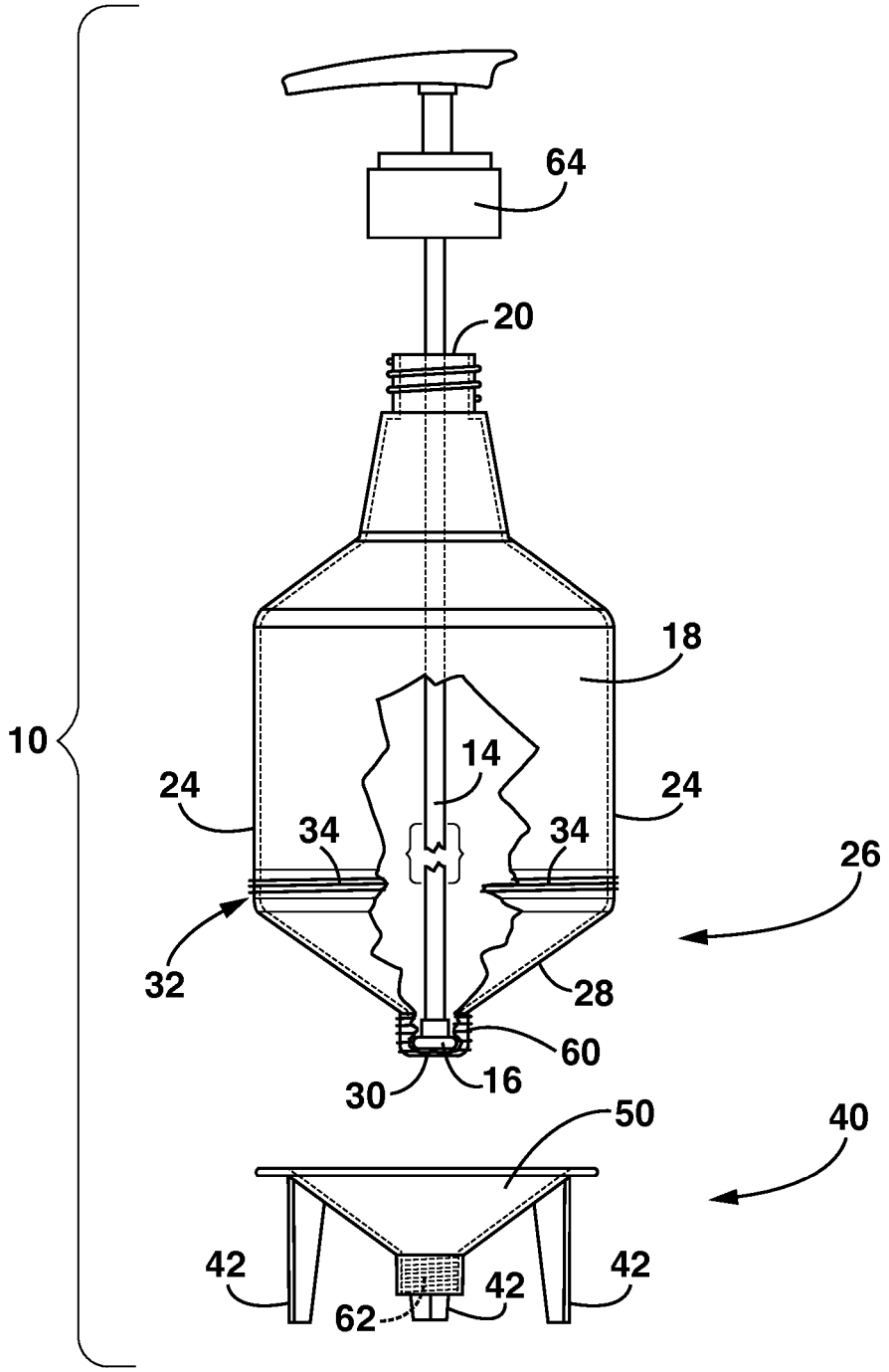
FIG. 2 is a cut-away exploded perspective view of one embodiment of the invention with pump head and a funnel and three-legged base.

FIG. 2 is a cut-away exploded perspective view of one embodiment of the invention with pump head and a funnel and a 3-legged base. Fluid dispensing apparatus 10 is similar to the one described in FIG. 1 except for some changes to single lower region 30, base 40 and funnel accessory 50. Base side 42 comprises three legs. There is a second affixing element (60) on the outside of single lower region 30 that detachably connects with a threaded attaching element (62) inside the spout of funnel accessory 50. Base 40 and funnel accessory 50 are unified.

Figure 3:
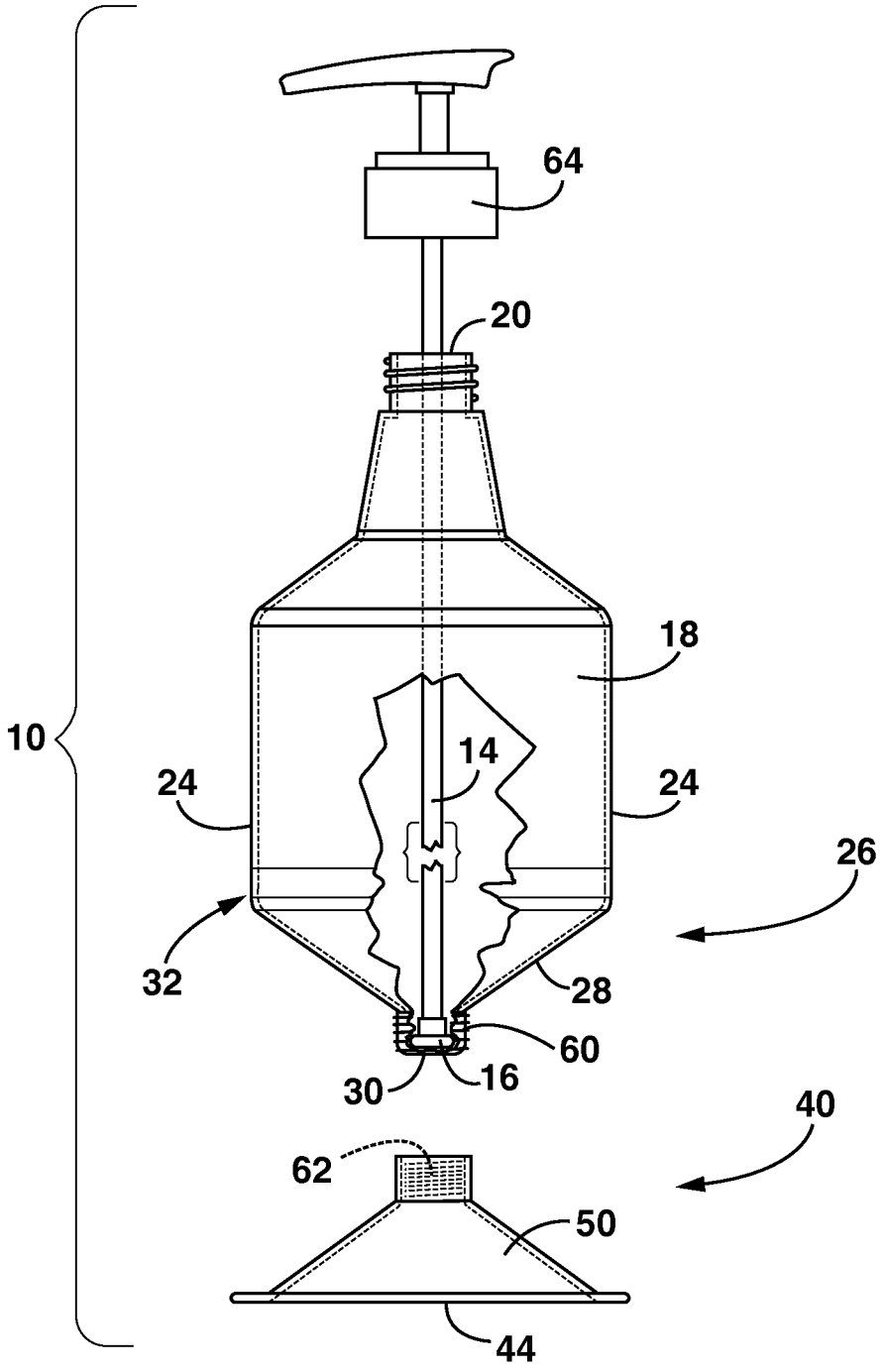
FIG. 3 is a cut-away exploded perspective view of one embodiment of the invention with pump head and a funnel in an upside-down position attached to bottom of conical bottom to be used as a base.

FIG. 3 is a cut-away exploded perspective view of one embodiment of the invention with pump head and a funnel that is upside-down and attached to the conical shaped bottom of a base. Fluid dispensing apparatus 10 is similar to the one described in FIG. 2 except for some changes to single lower region 30, base 40 and funnel accessory 50. Funnel accessory 50 and base 40 are the same.

Figure 4:
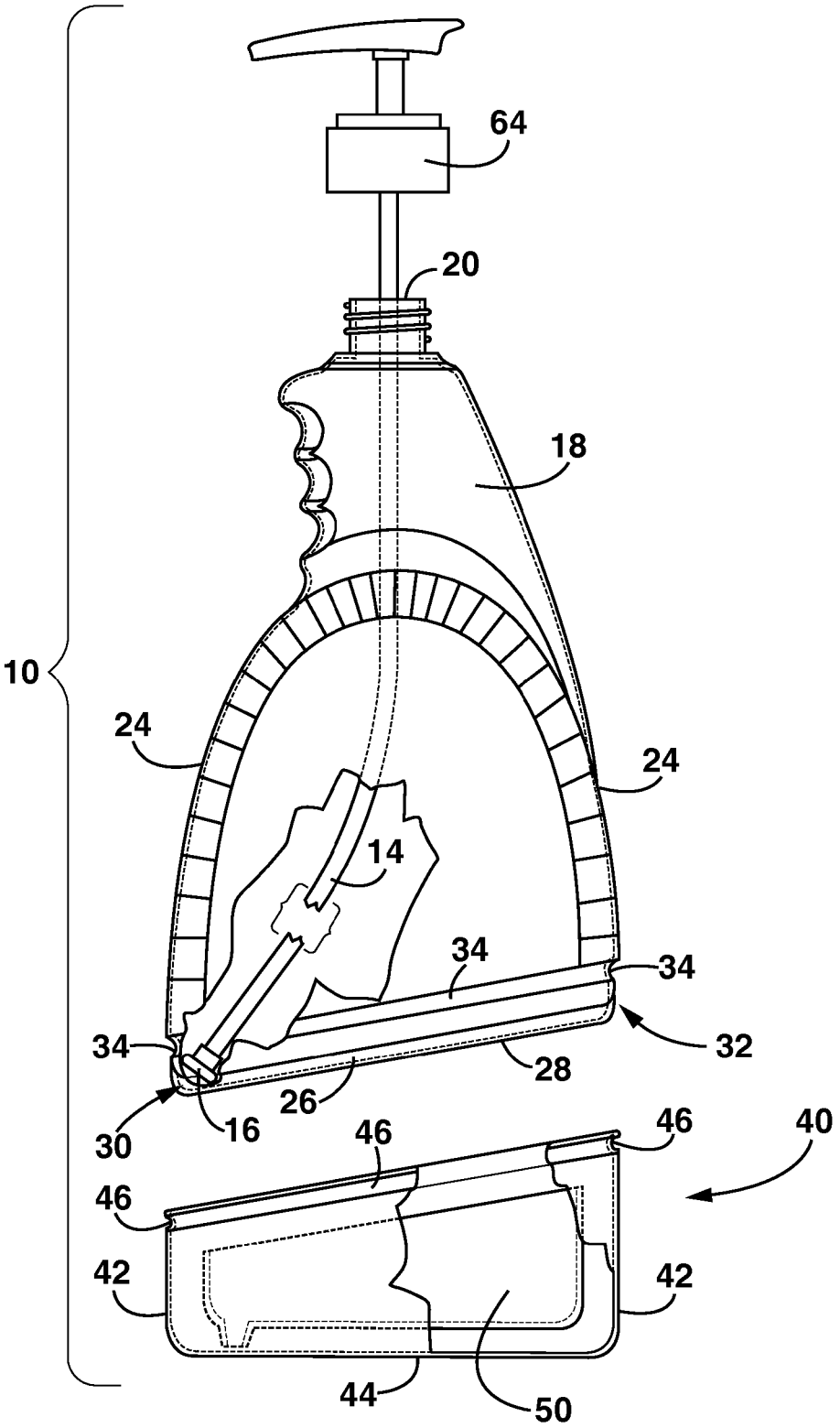
FIG. 4 is a cut-away exploded perspective view of one embodiment of the invention with pump head, a slanted and tilted bottom, and an elongated funnel attached to a slanted and tilted bottom.

FIG. 4 is a cut-away exploded perspective view of one embodiment of the invention with pump head, a slanted and tilted bottom, and a funnel that is elongated and proximate to a rectangular slanted and tilted bottom. Fluid dispensing apparatus 10 is similar to the one described in FIG. 1 except for some changes to fluid dispensing container 18, single lower region 30, base 40 and funnel accessory 50. Fluid dispensing head is a pump type (64). Side 24 is rectangular in orientation. Tapered shape 28 is slanted front to back and tilted left to right to have single lower region 30 in a corner. Affixing element 34 is a ridge and base attaching element 46 is a valley suitable for a releasable attachment in a snap-fit mode. Funnel accessory 50 is rectangular in shape with a spout in one corner to conform to the contour of bottom 26.

We have also invented a separate method of using embodiments where at least one of the accessories is a funnel. This method comprises eight steps. The first step is providing the above apparatus with the accessory comprising a funnel for use in dispensing fluid concentrate and dilution fluid in to the container. The second step is providing concentrate fluid product. The third step is detaching base member from container and removing funnel. The fourth step is removing dispensing head and placing funnel over top opening. The fifth step is adding concentrate fluid product in measured amount without spilling. The sixth step is adding diluting fluid without spilling. The seventh step is removing funnel and replace dispensing head on top. The eighth step is reattaching base member to container with funnel within the base member.

Reusable Wipe Accessory

Some embodiments are a fluid dispensing apparatus comprising at least a reusable non-paper sheet-like element for smoothly spreading dispensed fluid onto a surface. Conventional fluid dispensing apparatus combinations that contain paper wipes do not motivate consumers interested in minimizing waste. This is seen by an absence of such reusable containers in the marketplace. Sheet or pad wiping elements of the invention are reusable and suitable for spreading, wiping or smoothing a fluid that is applied on a surface, or scouring or polishing the surface.

The wipe is washable so it can be cleaned before returning to the fluid dispensing apparatus. Wipes can be made from carious commercially available materials. Some include, for example, cloth, micro-porous polymeric sheets, sponges and scouring pads such as SCOTCH BRITE® by 3M Company, Maplewood, Minn., and pliable polishing materials such as, for example, a clay used to polish surfaces such as automotive painted surfaces.

Figure 5:
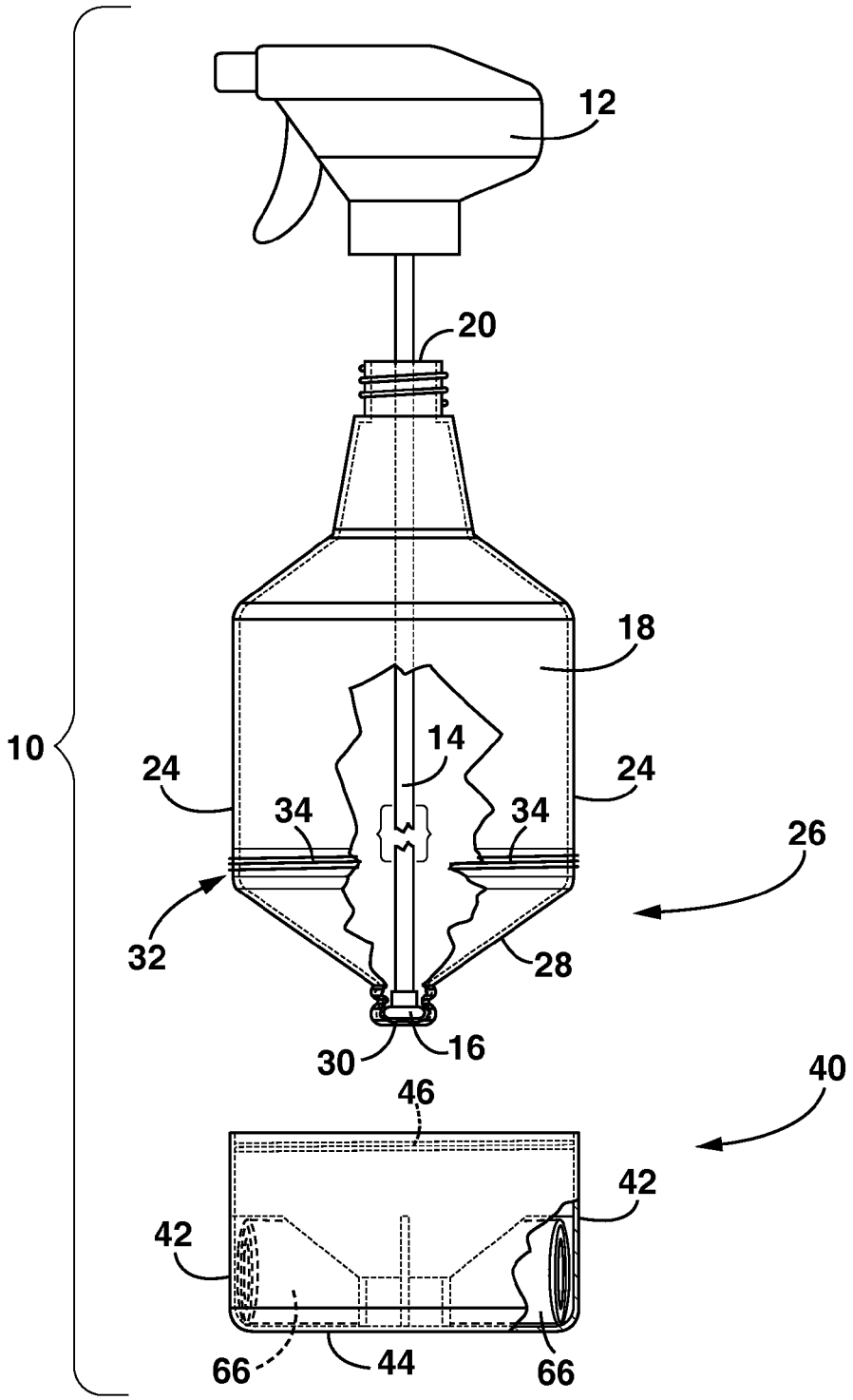
FIG. 5 is a cut-away exploded perspective view of one embodiment of the invention with spray head, conical bottom, and a reusable wipe.
Figure 6:
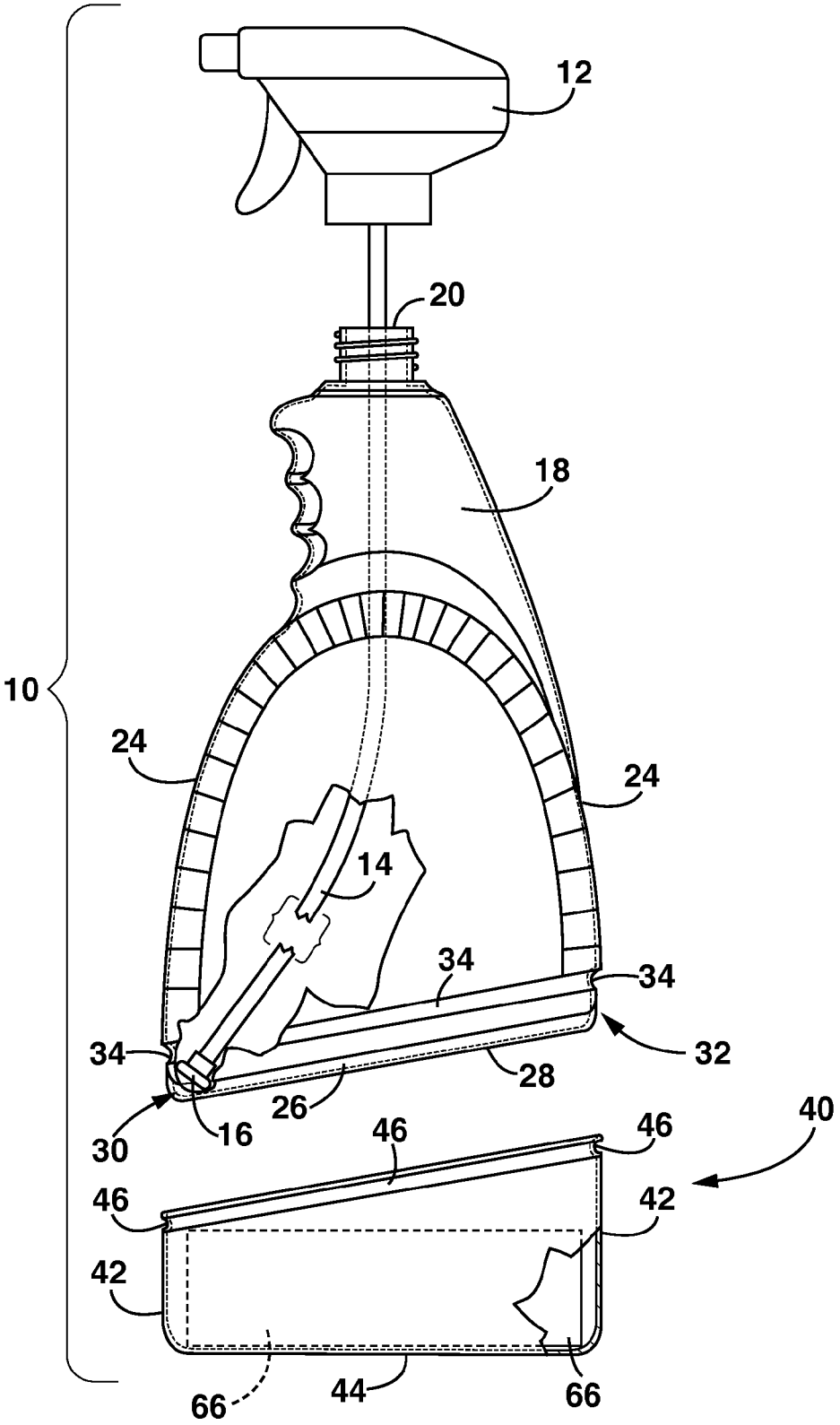
FIG. 6 is a cut-away exploded perspective view of one embodiment of the invention with a spray head, a slanted and tilted bottom, and a reusable wipe.

FIGS. 5 and 6 depict several embodiments where the accessory is a reusable wipe. FIG. 5 is a cut-away exploded perspective view of one embodiment of the invention with spray head, conical bottom, and a reusable wipe. Fluid dispensing apparatus 10 is composed of four elements. First is fluid dispensing head of a spray type 12 with dip tube 14 having end 16. Second is fluid dispensing container 18 comprising top 20, side 24 comprising two widening truncated cones and a cylinder, and bottom 26 with tapered shape 28 ending in single lower region 30, in this embodiment a recessed region with dip tube end 16 proximate lower region 30. Outer region 32 has affixing element 34, a threaded surface. Third is base 40 having side 42, base 44 that is substantially horizontal, and attaching element 46 inside the upper inside of the surface, a threaded surface. Fourth is a wipe accessory (66), a reusable wipe that is placed outside of bottom 26 and within base 40.

FIG. 6 is cut-away exploded perspective view of one embodiment of the invention with a spray head, a slanted and tilted bottom, and a reusable wipe. Fluid dispensing apparatus 10 is similar to the one described in FIG. 5 except for some changes to fluid dispensing container 18, single lower region 30 and base 40. Fluid dispensing head is pump type 64. Side 24 is rectangular in orientation. Tapered shape 28 is slanted front to back and tilted left to right to have single lower region 30 in a corner. Affixing element 34 is a ridge and base attaching element 46 is a valley suitable for a releasable attachment in a snap-fit mode.

We have also invented a separate method of using embodiments where at least one of the accessories is a reusable wipe. This method comprises six steps. The first step is providing the above apparatus with the accessory comprising a one reusable non-paper sheet-like wipe for smoothly spreading or wiping up dispensed fluid onto a desired surface. The second step is providing fluid product to apparatus. The third step is applying product to desired surface in droplet form. The fourth step is removing wipe from base member. The fifth step is spreading product onto or wiping up product from desired surface in a continuous coating. The sixth step is returning the wipe to the base member. In some embodiments, the method further comprises the step of cleaning the wipe before returning it to the base member.

Concentrate Accessory

Some embodiments are a fluid dispensing apparatus comprising at least a concentrate for making the fluid when dissolved in dilution fluid. It can be frustrating when a consumer reaches for a reusable fluid dispensing apparatus and cannot find the concentrates that are used to make the active solution. In the past, consumers just purchase single use dispensers with the fluid already inside. This results in greater waste in unused fluid and disposed containers. It also results in higher cost with the transporting and storage of the fluid used as a diluent, often water. Our invention provides the convenience of keeping the concentrates proximate the dispensing container, thus encouraging purchase by the consumer of a general use system that is more environmentally friendly than current systems. The concentrate may in various forms such as, for example, solid brick, powder, gel, or liquid. In some embodiments, the concentrate is in pre-weighed packets or sleeves for easier use by consumers. In some embodiments, the concentrate is in particulate form and may be accompanied with a pre-sized measuring scope. In some embodiments, the solid concentrate may be in the form of a solid mass with premeasured scorings for easy separation into desirable quantities. In some embodiments, the concentrate is a liquid in a small squeeze bottle with pre-marked graduations for multiple uses.

Figure 7:
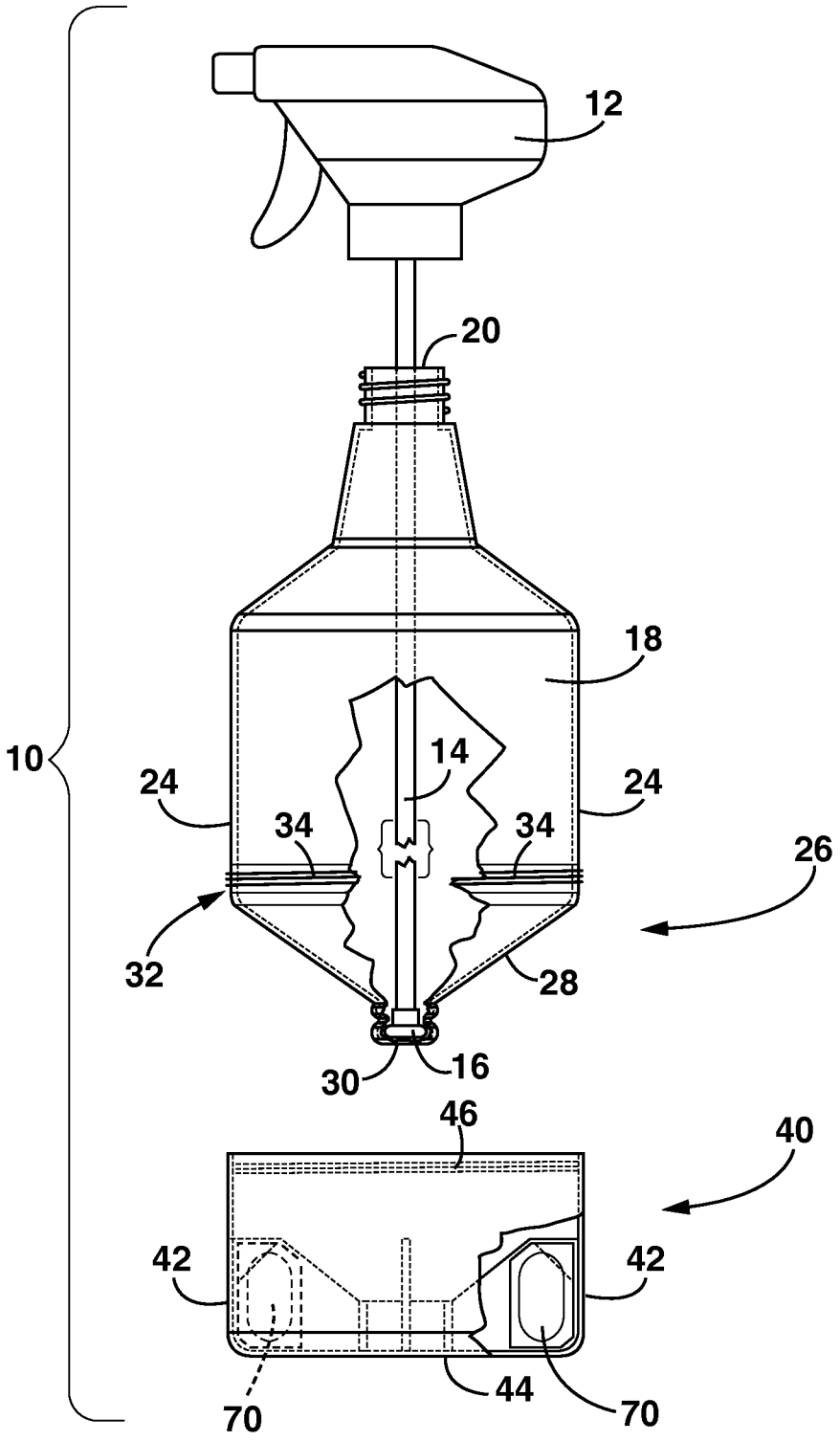
FIG. 7 is a cut-away exploded perspective view of one embodiment of the invention with spray head, conical bottom, and a packet of concentrate.
Figure 8:
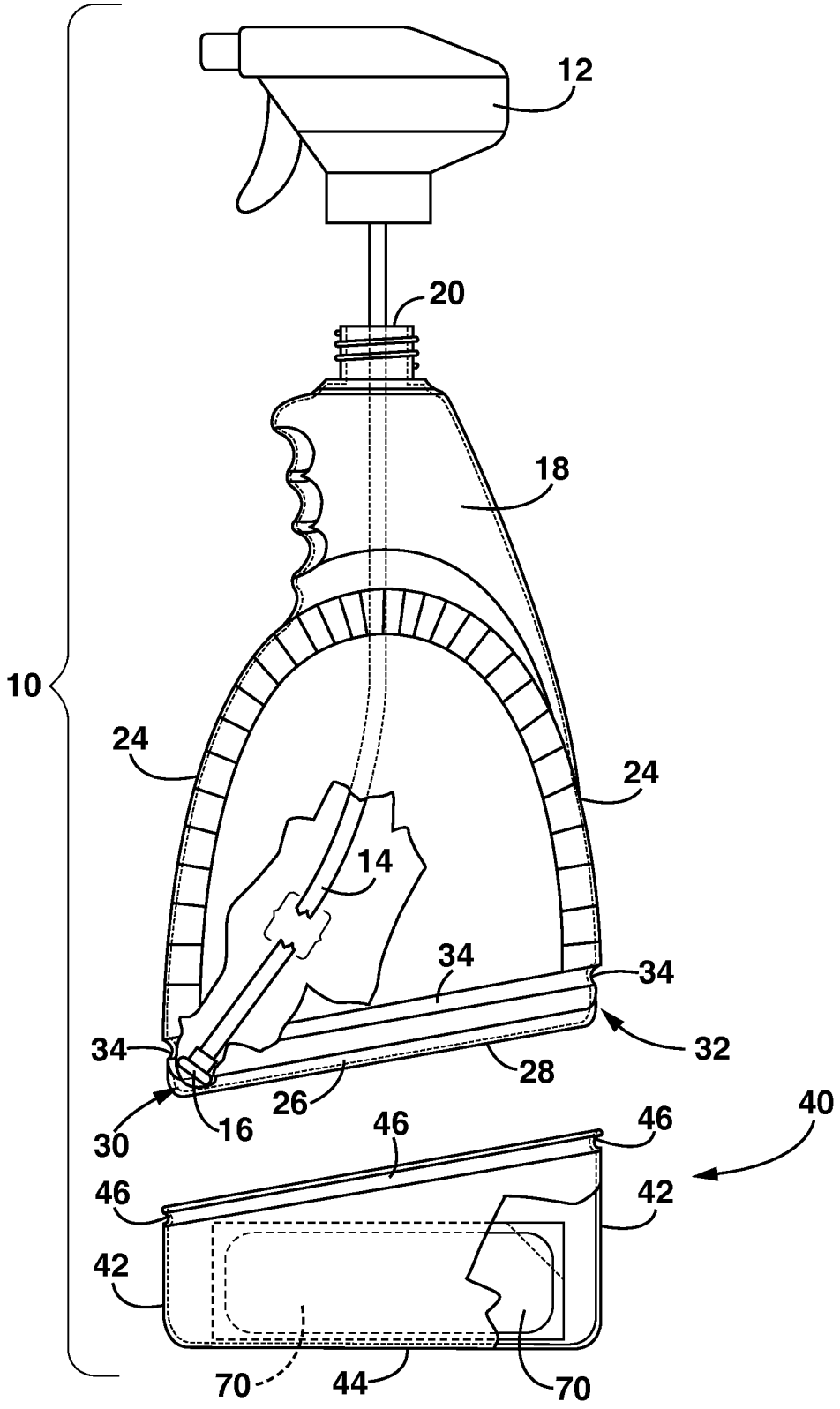
FIG. 8 is a cut-away exploded perspective view of one embodiment of the invention with spray head, slanted and tilted bottom, and a packet of concentrate.

FIGS. 7 and 8 depict an embodiment where the accessory is a concentrate that is solid. FIG. 7 is a cut-away exploded perspective view of one embodiment of the invention with spray head, conical bottom, and a packet of concentrate (70). Fluid dispensing apparatus 10 is composed of four elements. First is fluid dispensing head of a spray type 12 with dip tube 14 having end 16. Second is fluid dispensing container 18 comprising top 20, side 24 comprising two widening truncated cones and a cylinder, and bottom 26 with tapered shape 28 ending in single lower region 30, in this embodiment a recessed region with dip tube end 16 proximate lower region 30. Outer region 32 has affixing element 34, a threaded surface. Third is base 40 having side 42, base 44 that is substantially horizontal, and attaching element 46 inside the upper inside of the surface, a threaded surface. Fourth is accessory 70, a packet of concentrate is placed outside of bottom 26 and within base 40.

FIG. 8 is cut-away exploded perspective view of one embodiment of the invention with a spray head, a slanted and tilted bottom, and packet of solid concentrate 70. Fluid dispensing apparatus 10 is similar to the one described in FIG. 7 except for some changes to fluid dispensing container 18, single lower region 30 and base 40. Fluid dispensing head is pump type 64. Side 24 is rectangular in orientation. Tapered shape 28 is slanted front to back and tilted left to right to have single lower region 30 in a corner. Affixing element 34 is a ridge and base attaching element 46 is a valley suitable for a releasable attachment in a snap-fit mode.

We have also invented a separate method of using embodiments where at least one of the accessories is a concentrate. This method comprises six steps. The first step is providing the above apparatus with the accessory comprising solid concentrate for making the fluid when dissolved in water. The second step is removing solid concentrate from base member. The third step is removing dispensing head. The fourth step is adding concentrate fluid product in measured amount. The fifth step is adding diluting fluid. The sixth step is replacing dispensing head on top. Some embodiments further include a modification of the first step where the concentrate is in premeasured packets.

Other modifications and changes regarding my invention will be apparent to those skilled in the art. The invention is not considered limited to the embodiments chosen for purposes of disclosure and covers all changes and modifications that do not constitute departures from the true spirit and scope of this invention.

We claim:

1. A reusable fluid-dispensing apparatus comprising:

a fluid dispensing head with a descending dip tube having an end;

a container for holding fluid detachably connected to the fluid dispensing head and having:

a top with an opening detachably connected to the dispensing head, an outer edge, and an outer edge periphery;

sides having a top edge that is continuously affixed to the entire outer edge of the top, the outer edge periphery, and a bottom edge having an outer edge affixed to the bottom edge of the side;

a bottom having an outer perimeter that is continuously affixed to the bottom edge of the sides, a single lower region configured to accept the end of the dip tube such that the end of the dip tube is in the single lower region, and a shape that is tapered to direct fluid toward the single lower region in the bottom; and an outside region from just above the beginning of the taper to the lower region, the outside region having affixing elements; and a base member having an inside surface and attaching elements on the inside surface, and detachably connected to the container at the affixing elements to provide an approximately horizontal supporting orientation for the apparatus, the base member comprising a funnel for use in dispensing fluid concentrate and dilution fluid in to the container.

2. The apparatus of claim 1, wherein the shape of the outer periphery is selected from a group consisting of a circle, oval, square, rectangle, and polygon.

3. The apparatus of claim 1, wherein the base member comprises a funnel, the lower region of the bottom comprises an outside, and the funnel is affixed to outside of the lower region of the bottom.

4. The apparatus of claim 1, wherein the base member further comprises at least one reusable non-paper sheet-like element for smoothly spreading dispensed fluid onto a desired surface.

5. The apparatus of claim 4, wherein the non-paper sheet-like element comprises a material from a group consisting of cloth, micro-porous non-woven membranes, sponges, scouring material, and polishing material.

6. The apparatus of claim 1 wherein the base member further comprises a solid concentrate.

7. The apparatus of claim 6, wherein the solid concentrate comprises multiple pre-measured packets.

8. The apparatus of claim 1, wherein the fluid dispensing head comprises a spray head or a pump head.

9. The apparatus of claim 1, wherein the affixing and attaching elements are from a group consisting of grooves and ridges for snap-on attachment, threads for screw on attachment, mechanical fasteners for entanglement attachment, and friction surfaces for dry adhesion attachment.

10. The apparatus of claim 1, wherein the base member is detachably connected with the outside of the lower region of the bottom.

11. The apparatus of claim 1, wherein the base has at least three legs.

* * * * *